US005947341A

United States Patent [19]

Montaner et al.

[11] Patent Number: 5,947,341

[45] Date of Patent: Sep. 7, 1999

[54] TRIGGER SPRAYER HAVING REAR HOOD SUPPORTING A RETURN SPRING

[75] Inventors: Pedro Pares Montaner, Esplugues Barcelona; Lluis Costa Quintas, Barcelona, both of Spain

[73] Assignee: Monturas, S.A., Barcelona, Spain

[21] Appl. No.: 08/892,651

[22] Filed: Jul. 15, 1997

[30] Foreign Application Priority Data

Feb. 28, 1997 [ES] Spain ..... 9700435

[51] Int. Cl.[6] ..... B65D 88/54

[52] U.S. Cl. ..... 222/340; 222/383.1

[58] Field of Search ..... 222/340, 383.1

[56] References Cited

U.S. PATENT DOCUMENTS 4,815,663 3/1989 Tada ..... 222/383.1 X
5,211,315 5/1993 Geier ..... 222/383.1

*Primary Examiner*—Gregory L. Huson
*Attorney, Agent, or Firm*—Watson Cole Grindle Watson, P.L.L.C.

[57] ABSTRACT

A trigger actuator pump sprayer has a fixed portion at the rearward section of its pump body providing a hand positioner for supporting the pump sprayer when mounted to a container of liquid to be sprayed. Another portion of the rearward section of the pump body is open to facilitate manufacture of the pump body, and is closed by a hood having a fixed piston spring assembly external to the pump chamber for biasing the piston outwardly of its bore.

9 Claims, 2 Drawing Sheets

21
23
20
11
10
22
27
28
16
44
48
25
26
49
24
52
47
35
57
41
37
54
56
38
33
12
34
36
32
15
31

44
45
46
41

21
19
18
20
11
42
22
16
44
17
51
39
43
47
37
24
41
32
10
38
12
14
15
13
36
31

44
45
48
49
28
27
28
26
25
39
51
47
46
52
35
54
53
56
38
55
24
32
31
36

TRIGGER SPRAYER HAVING REAR HOOD SUPPORTING A RETURN SPRING

BACKGROUND OF THE INVENTION

This invention relates generally to trigger actuated pump sprayers, and more particularly to such sprayers as having a structure requiring low manufacturing cost and low assembly cost.

It is known for trigger sprayers to have improved ergonomic efficiencies by the provision of a hand positioner affixed to the rear portion of the pump housing as in U.S. Pat. No. 5,172,836, or a hand positioner made integral with the pump housing or with the container, as in U.S. Pat. No. 5,507,437. Such a hand positioner seats against the web of the user's hand between the thumb and index finger during spraying operations to thereby conveniently support especially a large container filled with liquid product to which the trigger sprayer is attached. In the U.S. Pat. No. 5,507,437, the hand positioner is in the form of a rear section of the housing which is hinged to the front section of the housing via a living hinge and is locked in place in a closed position during spraying. The rear section of the housing is hinged for pivotable movement from an open position for molding the housing, to a closed portion for operation of the trigger sprayer. The trigger sprayers of the aforedescribed types have piston return springs which are internal to the pump chamber and are therefore wetted with product which could prove undesirable due to product incapability problems.

Other trigger sprayers are known to include external "dry" piston return springs, as exemplified by U.S. Pat. Nos. 3,768,734, 5,297,701 and 5,299,717. Although the U.S. Pat. No. 5,297,701 discloses a hand gripping formation extending rearwardly from the top portion of the trigger sprayer body, such gripping formation is not in the form of an ergonomic hand positioner or saddle. And, the plastic spring assembly, which urges the trigger together with the piston back into their home positions, is located between the trigger in a position on the body located rearwardly of the trigger exterior of the pump chamber. The trigger lever must be coupled to the piston as the spring acts directly on the trigger for returning the piston out of its cylinder.

To facilitate the molding of especially a low cost trigger sprayer, it is sometimes necessary to provide open access to the pump body through an open rearward section which should subsequently be closed prior to use. As a low cost feature of the trigger sprayer, it would be of an advantage to provide a rear hood for both closing the rearward section of the trigger sprayer body and for supporting an external piston return spring. In such manner, both manufacture and assembly of the trigger sprayer is simplified and the number of parts are reduced to thereby lower the cost of manufacture and assembly. The hand positioner should form no part of the hood to avoid unlocking during use of especially a hinged hand positioner as in the prior art.

SUMMARY OF THE INVENTION

It is therefore an object of the present invention to provide a low cost trigger actuated pump sprayer having a pump body with a portion of its rearward section ergonomically shaped for resting against the web of an operator's hand during spraying, with another portion of such rearward section having an opening to facilitate manufacture of the pump body. A hood closes the opening during the spraying operation, and a "dry" external return spring is fixed to the hood. The piston return spring may therefore be assembled in place contemporaneously with a closing of the pump body opening by the hood, to thereby simplify the assembly procedure and reduce the attendant costs.

The return spring may be in the form of a leaf spring in constant tension after assembly as it engages a flange on the piston stem for biasing the piston outwardly of its bore. The trigger lever has a cammed end engaging the underside of the flange for shifting the piston inwardly of its bore against the bias of the leaf spring upon each pull of the trigger.

Other objects, advantages and novel features of the invention will become more apparent from the following detailed description of the invention when taken in conjunction with the accompanying drawings.

DETAILED DESCRIPTION OF THE INVENTION

Figure 1:
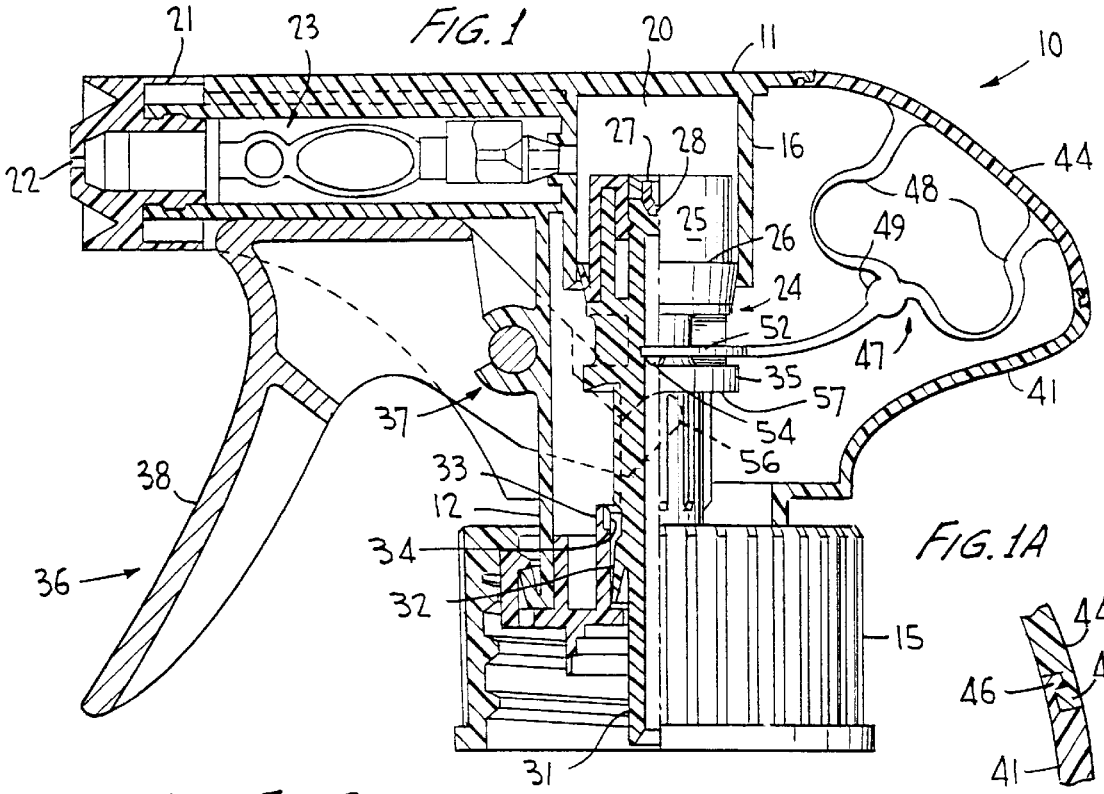
FIG. 1 is a vertical sectional view of a trigger actuated pump sprayer embodying the present invention, the sprayer being shown in an at rest position.
Figure 1A:
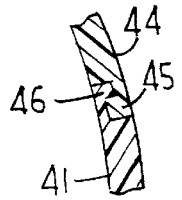
FIG. 1A is a detail view, at an enlarged scale, of the connection between the hood and the pump body.
Figure 2:
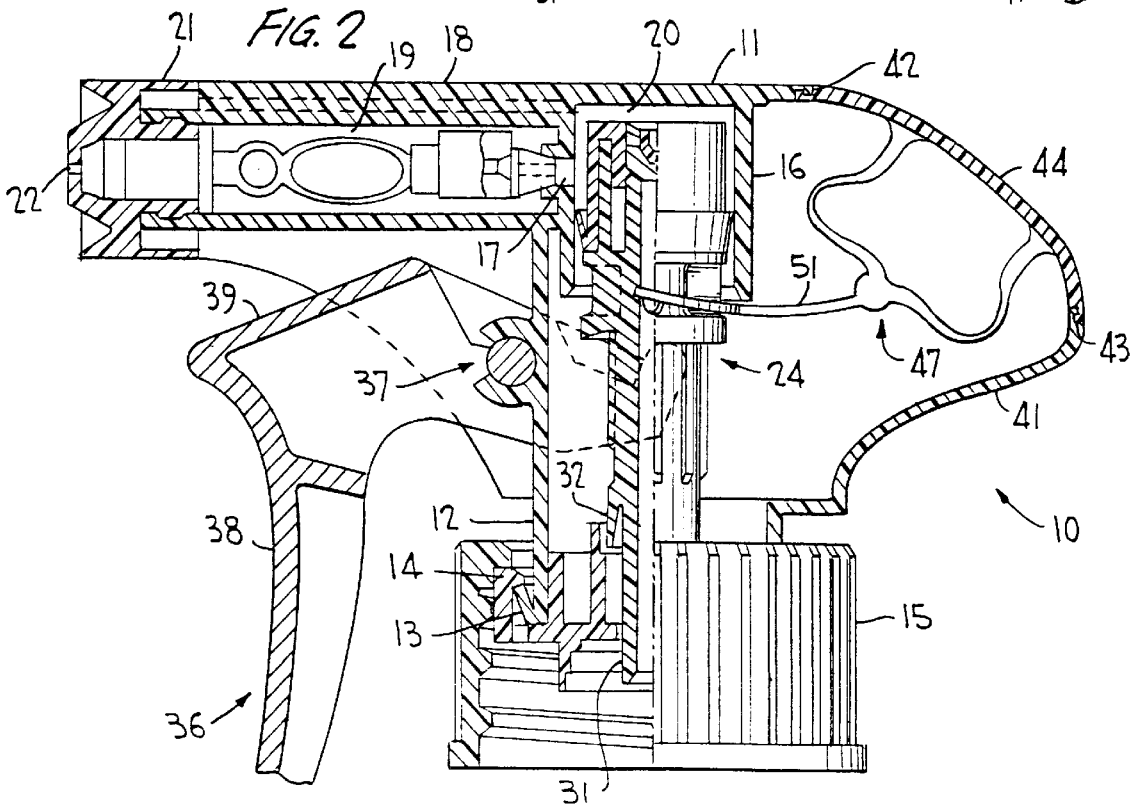
FIG. 2 is a view similar to FIG. 1 showing operation of the trigger actuator during pumping.

Turning now to the drawings wherein like reference characters refer to like and corresponding parts throughout the several views, a trigger actuated pump sprayer embodying the present invention is illustrated in FIGS. 1 and 2, generally designated 10, and comprises a pump body 11 of molded plastic construction having a cylindrical attaching portion 12 with an outwardly folded lower end 13 snap-fitted to a retainer 14 for coupling to a closure cap 15 to facilitate the mounting of the pump sprayer to the neck of a container of liquid to be sprayed. The coupling of the pump body to the closure cap forms no part of the invention, and is disclosed in commonly owned application Ser. No. 08/868,946, filed Jun. 4, 1997, now U.S. Pat. No. 5,873,496 and entitled "Assembly For Fixing Closure Cap to Dispenser Body."

An integrally molded pump cylinder 16 of the pump body has a discharge port 17 opening into a discharge barrel 18 forming a discharge passage 19 having at its distal end a nozzle cap 21 containing a discharge orifice 22. A combined spinner/discharge valve assembly 23 having spring biasing means for the discharge valve is located in the discharge passage, and forms no part of the invention.

Figure 3:
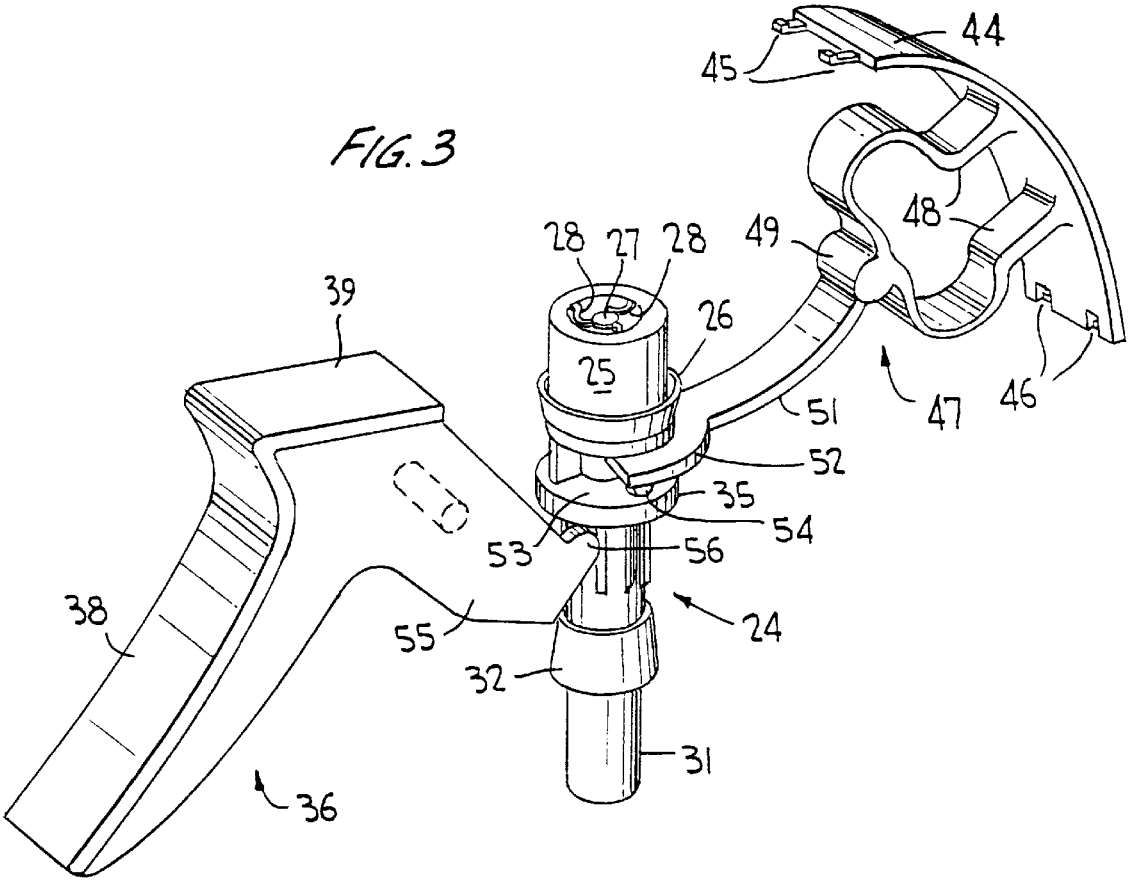
FIG. 3 is a perspective view of the trigger actuator and the pump body hood/external spring relative to the piston stem.

A reciprocable piston assembly 24 includes a piston cup 25 having its piston seal 26 in fluid-tight sealing engagement with the inner wall of pump cylinder 16. Cup 25, as more clearly shown in FIG. 3, has an inlet check valve in the form of a spider valve comprising a valve disc 27 mounted in place via resilient spider legs 28, as known in is the art. Disc 27 seats against its valve seat 28 (FIG. 1) in all positions of the piston other than when undergoing its suction strokes.

The piston assembly includes a piston stem 31 at the upper end of which the piston cup is frictionally mounted. The stem has a downwardly flaring container vent seal 32 in sliding sealing engagement with the inner wall of an upstanding sleeve 33 of retainer 14 for venting the interior of the container to atmosphere when vent seal 32 engages vent grooves 34 formed on the inner wall of sleeve 33, at or near the end of piston compression stroke shown in FIG. 2.

The piston stem further has a transversely extending annular flange 35 spaced a predetermined distance below piston seal 26.

A trigger actuator 36 is mounted to the pump body as at 37 for pivotal movement between the FIG. 1 and the FIG. 2 positions upon a manual pull of trigger lever 38. The trigger actuator has a flat upper surface 39 adapted for engagement with the underside of discharge barrel 18 acting as a limit stop in the outward hinged direction of the trigger actuator of FIG. 1.

As one of the features of the invention the pump body has a portion 41 at its rearward section which is ergonomically shaped for resting against the web of an operator's hand (not shown) during operation of the sprayer. Portion 41 is integrally molded with the pump body, and extends rearwardly from cylindrical attaching portion 12. The portion 41 forms a hand positioner which, when resting on the web of the operator's hand between the thumb and forefinger, supports the weight of the attached liquid filled container safely and conveniently on the top of the operator's hand.

Another portion of the rearward section of the pump body is open, i.e., that portion between edges 42 and 43 at the rearward section of the pump body. This opening facilitates manufacture of the pump body, and the opening is conveniently closed by a hood 44 having male/female catches 45, 46 at opposite ends which cooperate with like female/male catches at edges 42, 43 of the pump body. Hood 44 provides a smooth continuation at the rear section to provide a smooth contour as shown.

Hood 44 has affixed to its underside an external piston return spring assembly 47 which may comprise a pair of spaced bulbous spring legs 48 joined by a hub 49, and a leaf spring or spring arm 51 extending from hub 49 being essentially flat and unbent before assembly. Spring arm 51 has a forked end 52 defining a pair of spaced fingers which partially surround piston stem 31, and overlie top surface 53 of flange 35. The spaced fingers of forked end 52 has at the undersurface thereof a hemi-spherically shaped, transversely extending cam 54 presenting line contact against upper surface 53 of flange 35. When hood 44 is installed with the forked end of the spring in place as shown in FIG. 1, spring arm 51 is placed in tension and resiliently moves the piston out of its bore to the fullest extent possible as permitted by vent seal 32 bottoming out within sleeve 33.

The trigger actuator has a rearwardly extending arm 55 with a cammed edge 56 at its end in engagement with undersurface 57 of flange 35.

In the at rest position of FIG. 1, spring arm 51 resiliently presses flange 35 against edge 56 of the trigger actuator whereby its upper surface 39 bears against the underside of the discharge barrel to limit the trigger actuator to its position shown in FIG. 1.

Upon each manual pull of the trigger lever, arm 55 pivots counterclockwise about mount 37 such that cam edge 56 shifts the piston assembly upwardly against the bias of spring assembly 47 whereupon the piston slides within the cylinder bore compressing the liquid therein which has been suctioned into pump chamber 20 during the previous suction stroke. Thus, assuming pump chamber 20 to be primed with liquid product, the liquid is sprayed during each piston compression stroke out of orifice 22 as the pressurized liquid from the pump chamber opens the discharge valve of assembly 23, as in a manner known in the art.

As manual pull pressure applied against the trigger lever is relaxed, trigger actuator 36 is returned to its FIG. 1 position by spring assembly 47 which simultaneously pulls the piston out of its bore to thereby expand pump chamber 20 permitting liquid to be suctioned from the container (not shown) back into the pump chamber as in a manner know in the art.

The hood with its attached piston spring assembly provides a smooth contoured profile for the rearward section of the low cost trigger sprayer while at the same time functions as an external dry spring which saves a part and thereby saves cost and which is easy to assemble. The fixed portion of the rearward section of the pump body functions as a hand positioner for the pump sprayer without the possibility of its unsnapping or unloosening during use as in some prior art designs.

Obviously, many modifications and variations of the present invention are made possible in the light of the above teachings. It is therefore to be understood that within the scope of the appended claims the invention may be practiced otherwise than as is specifically described.

What is claimed is:

1. A trigger actuated pump sprayer for attachment to a container of liquid to be dispensed, comprising, a pump body having a pump cylinder, a pump piston reciprocable within said cylinder to therewith define a variable volume pump chamber, a trigger actuator coupled to said body in engagement with said piston for reciprocation thereof against the force of a piston return spring disposed external to said pump chamber, characterized in that said pump body has an integral rearward section one portion of which is ergonomically shaped for resting against the web of an operator's hand during operation of the sprayer, another portion of said rearward section having an opening to facilitate manufacture of the pump body, a hood closing said opening during the operation of the sprayer, said return spring being fixed to said hood, and means for locking said hood to said pump body when closed over said opening.

2. The sprayer according to claim 1, characterized in that said return spring has a spring arm engaging a stem of said piston for biasing said piston outwardly of said cylinder.

3. The sprayer according to claim 1, characterized in that said hood when closed over said opening engages said one portion and is shaped to form a smooth transition between said one portion and adjoining portions of said pump body.

4. The sprayer according to claim 1, characterized in that said piston has a stem with a transverse flange located outboard of said chamber, said return spring having a spring arm with a forked end engaging a first surface of said flange confronting said chamber for biasing said piston outwardly of said chamber.

5. The sprayer according to claim 4, characterized in that said trigger actuator has a forwardly extending hand lever and a rearwardly extending piston operating lever having a terminal cam engaging a second surface of said flange opposite said first surface for transmitting to said piston a manual pull force applied to said hand lever.

6. The sprayer according to claim 1, characterized in that said pump body has a cylindrical attaching portion for attachment to the container, said piston and said cylinder being coaxial with said attaching portion.

7. The sprayer according to claim 1, characterized in that said hood and said fixed return spring are of molded one-piece construction.

8. The sprayer according to claim 6, characterized in that said hood and said fixed return spring are of molded one-piece construction, said spring having a forwardly extending spring arm engaging a stem of said piston for biasing said piston outwardly of said cylinder.

9. The sprayer according to claim 4, characterized in that said forked end has rounded bearing surfaces making line contact with said first surface.

* * * * *